United States Patent [19]

Kalfon

[11] Patent Number: 4,731,819

[45] Date of Patent: Mar. 15, 1988

[54] PREPAYMENT PRODUCT OR SERVICE DISPENSER

[76] Inventor: Renë Kalfon, 816 rue de la Haie, 76230 Bois Guillaume, France

[21] Appl. No.: 893,292

[22] PCT Filed: Nov. 25, 1985

[86] PCT No.: PCT/FR85/00333

§ 371 Date: Jun. 21, 1986

§ 102(e) Date: Jun. 21, 1986

[30] Foreign Application Priority Data

Nov. 26, 1984 [FR] France ..... 84 17979

[51] Int. Cl.[4] ..... H01M 17/00

[52] U.S. Cl. ..... 379/145; 109/52; 312/245; 379/143

[58] Field of Search ..... 379/33, 123, 132, 143, 379/145, 149, 150, 153; 455/90, 26; 235/379; 248/551, 553, 225.1, 225.2, 225.3, 222.1; 312/101, 245; 109/48, 49, 50, 52, 45

[56] References Cited

U.S. PATENT DOCUMENTS

| | | | |
|---|---|---|---|
| 2,734,764 | 2/1956 | Angelo . | |
| 3,056,544 | 10/1962 | Sollenberger et al. . | |
| 3,260,338 | 7/1966 | La Barge | 379/150 |
| 3,317,674 | 5/1967 | Nawman | 379/153 |
| 3,391,256 | 7/1968 | Nawman | 379/143 |
| 4,151,380 | 4/1979 | Blomeyer et al. | 379/143 |
| 4,244,304 | 1/1981 | Read | 109/52 |
| 4,462,317 | 7/1984 | Franko et al. | 109/45 |
| 4,577,563 | 3/1986 | Sidler | 109/52 |
| 4,645,876 | 2/1987 | Albertson | 379/143 |

FOREIGN PATENT DOCUMENTS

| | | |
|---|---|---|
| 2936504 | 3/1981 | Fed. Rep. of Germany . |
| 2016203 | 5/1970 | France . |
| 2107280 | 5/1972 | France . |
| 2405602 | 4/1979 | France . |
| 249257 | 3/1948 | Switzerland . |
| 546023 | 2/1974 | Switzerland . |
| 568626 | 10/1975 | Switzerland . |
| 995220 | 6/1965 | United Kingdom . |
| 1310567 | 3/1973 | United Kingdom . |
| 2005517 | 4/1979 | United Kingdom . |
| 2120723 | 12/1983 | United Kingdom . |

*Primary Examiner*—Robert Lev

*Attorney, Agent, or Firm*—Lowe, Price, LeBlanc, Becker & Shur

[57] ABSTRACT

The apparatus comprises a post anchored to the ground including a closable compartment containing a removable coin box, and a container attachable to the post. The post comprises means for concomitantly opening the compartment, extracting the coin box from the compartment and releasing the container from the post for access to internal means included in the post and the container. The apparatus has only a single entrance for access to the coin box compartment and internal means, thus providing effective protection to the interior of the apparatus at low cost.

28 Claims, 10 Drawing Figures

26
260
28
27
20
2
290
62
633
620
631
10
29
631
290
630
632
630
63
107
6
122
121
13
12
60
1
307
L1
L2
52
305
61
3040
57
55
312
40
5
310
42
314
531
301
308
306
304
3060
311
31
50
532
α3
302
144
(FIG.9)
147
41
530
30
833
146
313
130
3
303
52
120
4
51
53

PREPAYMENT PRODUCT OR SERVICE DISPENSER

CROSS REFERENCES TO RELATED APPLICATIONS

Applicant thereby makes cross references to his patent application PCT/FR 85/00 333, filed Nov. 25, 1985 and claims priority thereunder following the provisions of 35 U.S.C. 119.

BACKGROUND OF THE INVENTION

1. Field of the Invention

The present invention relates to a prepayment product or service dispensing apparatus comprising a post anchored to the ground and including a closable compartment containing a removable coin box, and a container attachable to the post.

2. Description of the Prior Art

The dispensing apparatuses concerned by the invention are, for example:

- dispensers of products such as photocopies, transport tickets, confectionary, newspapers, books, cigarettes or coins, and
- dispensers of services such as telephone communications, to which reference will be made in a preferred embodiment described subsequently, or parking authorization times, or games.

All these apparatuses comprise mechanical and electromechanical devices, part of which are contained in the post and part of which are contained in the container, and have at least two entrances locked by key which serve as access to internal devices of the apparatus. One of these entrances is a pivoting door closing the coin box compartment which is often partitioned off from the other devices contained in the post. Another entrance is a container door or a locking device allowing a part of the container to be removed.

In addition, the majority of these apparatuses have a large number of projections or salient surfaces making it easier to break into the apparatus using a tool as a lever arm. In particular, a tool may be used in this way to force the door of the locked compartment, since the door is pivotable.

Furthermore, a person in charge of removing the coin box and maintaining the apparatus must performs several distinct and often complex operations in order to open the compartment, remove the coin box and gain access to the interior of the post and the container. These operations are often long and painstaking because of the measures taken to improve the security and the robustness of the apparatus.

OBJECTS OF THE INVENTION

The main object of the invention is to provide a dispensing apparatus doing away with the above mentioned disadvantages, in particular, offering but a single entrance for access to the coin box compartment and the internal devices of the apparatus, and only requiring a single continuous operation to extract the coin box and release the container from the post. The fact that there is only one entrance, such as the compartment door, provides effective protection of the inside of the apparatus at a lower cost. When the container and the post are robust and free of projecting points, the apparatus is practically vandal-proof.

SUMMARY OF THE INVENTION

Accordingly, a dispensing apparatus such as defined under the "field of the invention" is characterized in that it comprises means for concomitantly opening the compartment, extracting the coin box from the compartment and releasing the container from the post for access to internal means included in the post and the container.

According to features of the invention, the apparatus comprises a means for simultaneously translating the coin box and a door closing the compartment towards the outside of the post, and means controllable from the open compartment for releasing the container from the post. The translating means is pivotable when the coin box and the door are outside the post and is connected to the releasing means. Pivoting of the translating means causes release of the container in relation to the post via the releasing means. A collecter may thus in a single and continuous operation translate the coin box outwards by opening the door of the compartment and pivot the translating means to release the container from the post and, in particular, to raise the container above the post in order to remove the full coin box and repair internal devices in the post and/or container.

According to other features of the invention, the apparatus comprises contact means operating working mechanically in conjunction with a surface of the coin box and/or a portion of the compartment door in order to signal abnormal absence of the coin box in the compartment and/or abnormal opening of the compartment respectively. This signalling may be performed by means of a loudspeaker emitting an audible alarm signal and/or by means of a telephone transmitter transmitting an alarm signal through a telephone line to notify surveillance service, such as the police.

According to another feature of the invention, the security of access to the compartment is improved by a counter-door fixed against the door closing the coin box compartment. A contact means cooperating with an internal portion of the counter-door is provided to signal abnormal distancing of the counter-door in relation to the door.

When the dispensing apparatus is in particular a public telephone apparatus equipped with a telephone handset having a removable microphone and a removable earpiece, and with a flexible cord connecting the handset to the post, the invention provides a means of to a large extent avoiding tearing off of the handset and theft of the capsules, whilst enabling a collector to replace faulty handset capsules. For this purpose, the apparatus comprises means controllable from the inside of the compartment for separating said microphone and earpiece capsules from the handset. Preferably, the separating means comprises means sliding within the handset and disengageable from the capsules, and a traction cable, preferably sheathed, passing through the cord. The cable has a first end attached to the sliding and disengageable means and a second end accessible inside the compartment.

BRIEF DESCRIPTION OF THE DRAWING

The other features and advantages of the present invention will be apparent from the following detailed description of several preferred embodiments of the invention with reference to the corresponding accompanying drawings in which:

FIG. 5 is a top view of the door and counter-door after break-in;

DESCRIPTION OF THE PREFERRED EMBODIMENTS

A preferred embodiment of a prepayment dispensing apparatus for services such as telephone communications is described hereinafter. The apparatus thus constitutes a public telephone apparatus.

Figure 2:
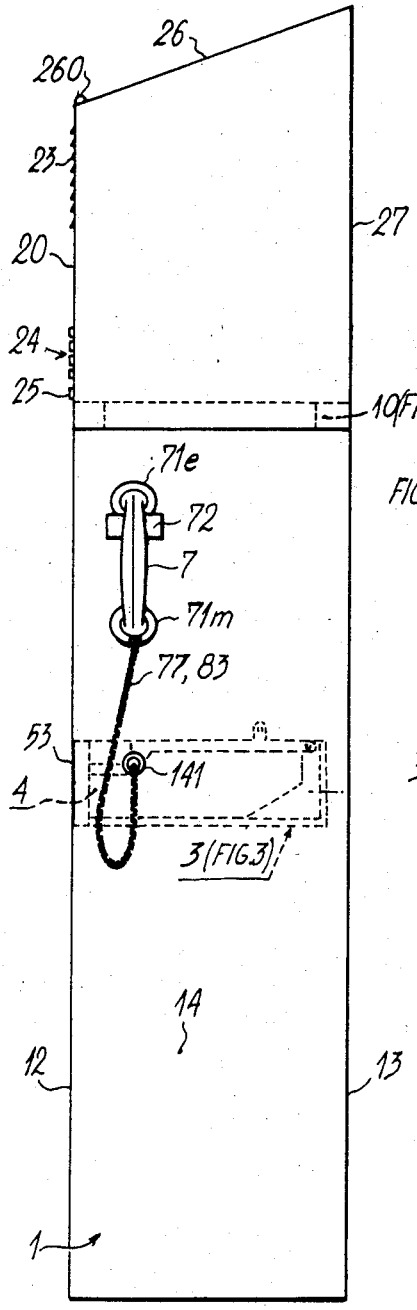
FIG. 2 is a vertical side view of the telephone apparatus.
Figure 1:
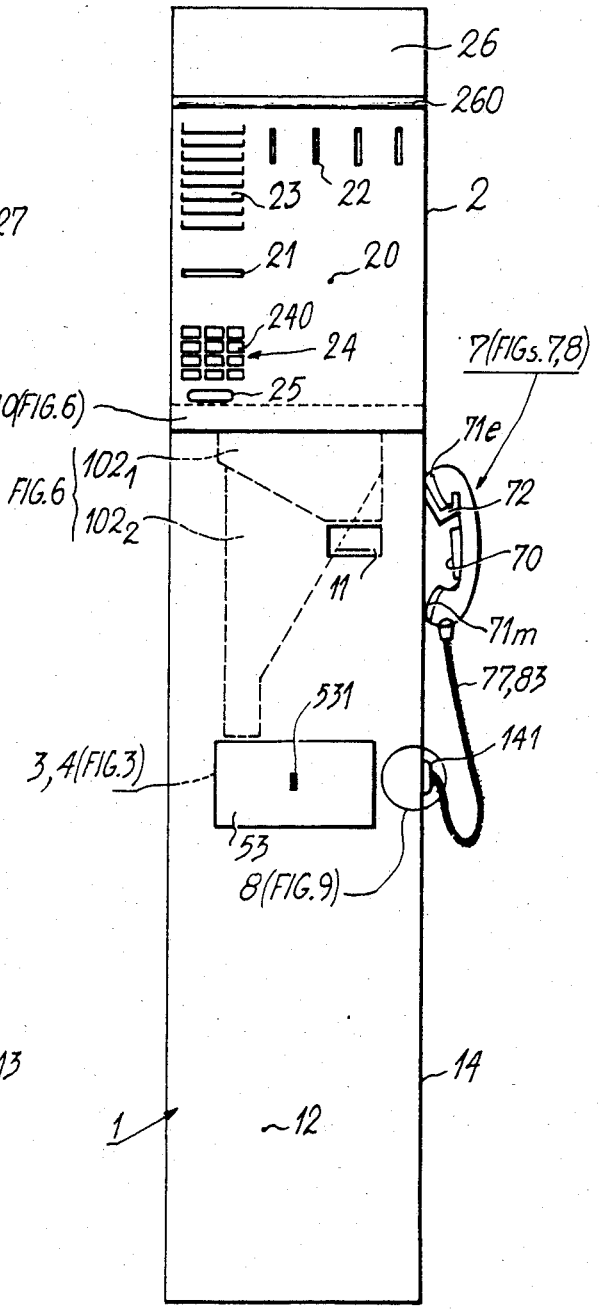
FIG. 1 is a vertical front view of a service dispensing apparatus such as a public telephone apparatus.

As schematically shown in FIGS. 1 and 2, the apparatus takes the form of a vertical hollow column having a rectangular horizontal cross-section. The height of the column as well as locations of parts of apparatus members accessible to a user are determined according to ergonomic criteria. The column is made of, in a lower part, a monobloc post 1 of reinforced concrete or steel and, in a higher part, a monobloc hollow container 2, also made of a hardwearing material such as stainless steel. The post 1 is solidly anchored to the ground. The container 2 caps an upper part of the post 1 formed by a base 10.

In a front panel 20, the container 2 comprises different orifices and members used by the user to establish and break a telephone communication. Preferably, a telephone communication may be prepaid by means of a magnetic or electronic card and by means of coins, either of these payment modes able to be used by the user at the beginning of or at any moment during the telephone communication. In addition, the telephone apparatus may establish outgoing communications and receive incoming telephone communications. Thus the front panel 20 of the container 2 comprises a slot 21 for inserting a card, slots 22 for insertion of various coins, for example 1 FF, 2 FF, 5 FF and 10 FF coins, and a perforated surface 23 behind which is located an audio pack for "free-hands" use and comprising a microphone and an amplified loudspeaker. The loudspeaker enables a call tone to be broadcast to call a user. The front panel 20 of the container also has suitable orifices through which are inserted twelve keys 240 of a dialling keyboard 24 and an orifice through which is inserted a refund pushbutton 25. Pressing in pushbutton 25 triggers breakage of telephone communication, and ejection of a card through slot 21 or refunding of coins in a refund dish 11 accessible on a front panel 12 of the post 1. On the upper part, container 2 has a downwards sloping top panel 26, from and a rear panel 27 to front panel 20, forming a console with front surround 260.

Figure 3:
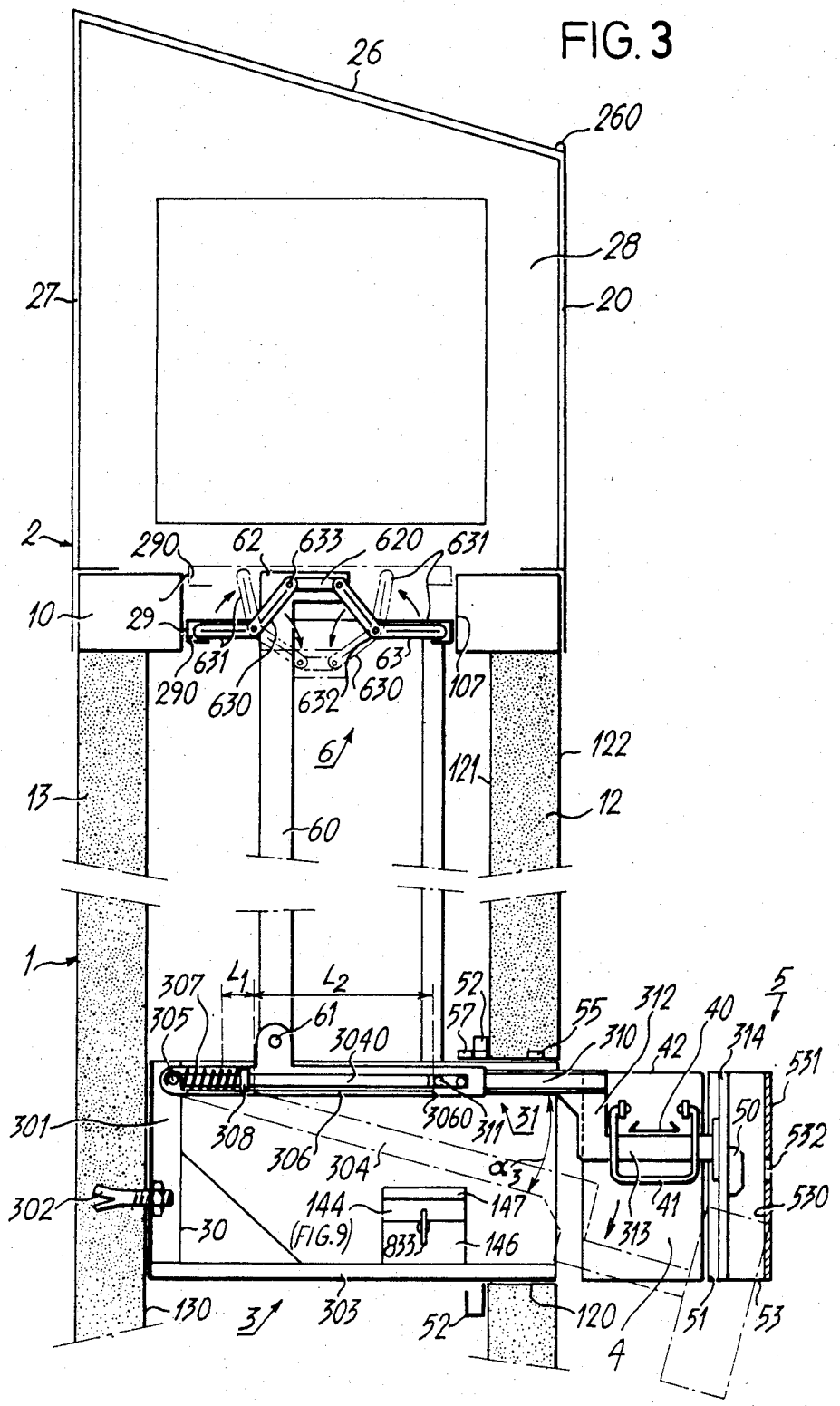
FIG. 3 is a partially cross-sectional vertical side view showing a drawer carrying a coin box, slidable and pivotable in a coin box compartment of a telephone apparatus post, as well as a device for releasing an upper container of the telephone apparatus.

The container 2 completely covers a chassis 28 attached to the top of base 10. The chassis is typically formed of iron uprights and cross-members, as schematically shown in FIG. 3. Chassis 28 supports various mechanical and electromechanical means housed in the container and generally designed for establishing and breaking a telephone communication, such as the audio pack with loudspeaker and microphone already mentioned, electromechanical card reading means, and electromechanical coin sorting and testing means as well as storage pending collection or refund. A case, described later on with reference to FIG. 10, contains electromechaniccal means, such as keys and contacts, of the dialling keyboard 24 and the refund button 25, and is attached to container 2.

As schematically shown in FIGS. 1 and 2 and in more detail in FIG. 3, post 1 comprises a compartment 3 containing a removable coin box 4 and opened by a door and lock mechanism 5 in the front wall 12 of the post, a locking device 6 for joining the container 2 onto the post 1 and separating the container from post 1, a telephone handset 7 with trigger 70 and a release mechanism 8 for separating a removable microphone capsule 71*m* and removable earpiece capsule 71*e* from handset 7. On the side of post 1, a hook 72 is provided for the handset 7. When the trigger 70 is pressed, the microphone and the loudspeaker located behind the perfored surface 23 are disconnected from the telephone line serving the telephone apparatus, and microphone 71*m* and earpiece 71*e* of the handset are connected to the telephone line.

Figure 4:
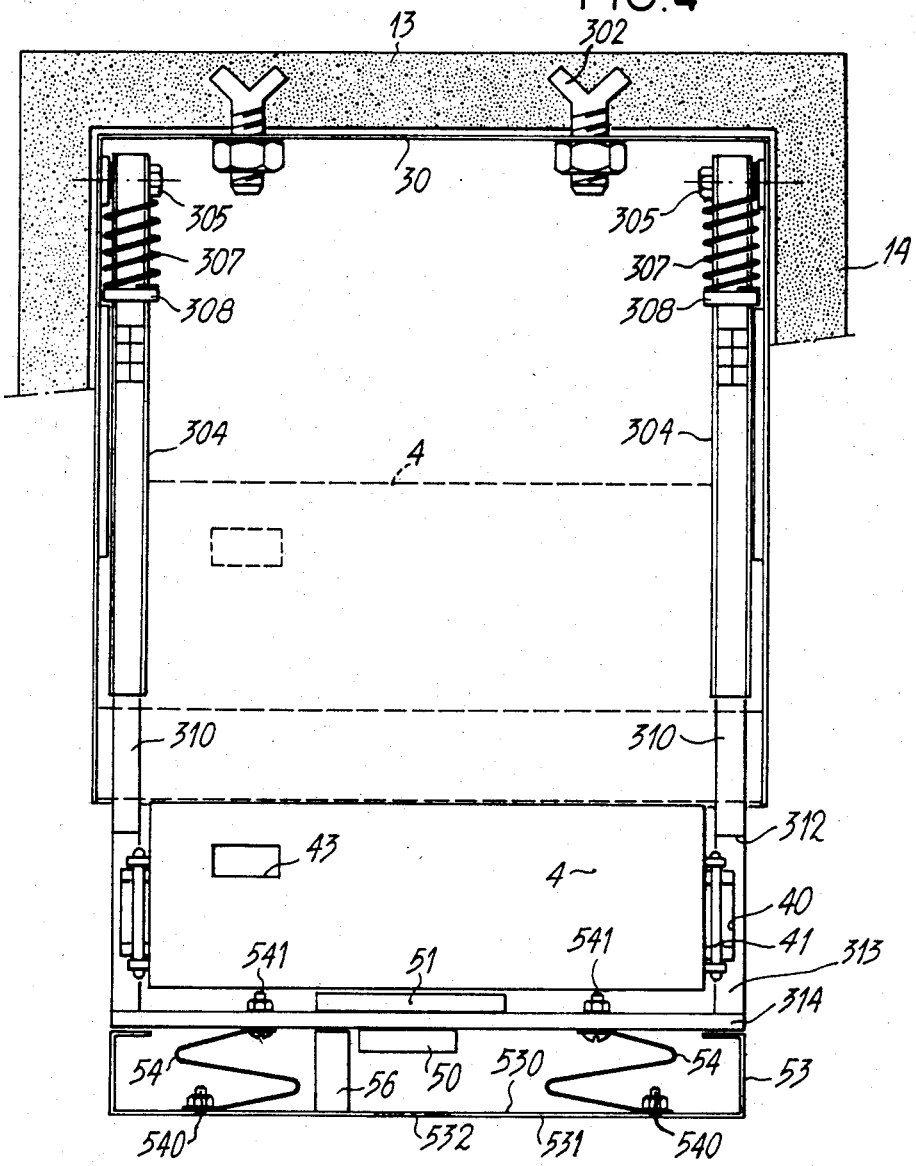
FIG. 4 is a partially cross-sectional top view of the compartment with coin box drawer, door and counter-door.

With reference to FIGS. 3 and 4, the coin box compartment 3 comprises a sheet metal chassis 30 into which slides a drawer 31 receiving the coin box 5 and equipped with door and lock mechanism 5.

The chassis 30 is generally of a hollow parallelepipedic shape, open to the top and front and located between an internal face 130 of a rear wall 13 of post 1 and a rectangular opening 120 made in the front wall 12. A vertical rear side 301 of the chassis is attached to the wall 13 by means of studs 302 one end of each of which is split and buried in the post and the other is threaded and receives a locking nut. A front end of a bottom 303 of chassis 30 rests on a horizontal side of opening 120.

The chassis 30 is equipped with two hollow pivoting arms 304 which extend horizontally when the drawer 31 is not pulled fully forwards as will be seen hereinafter. Back ends of arms 304 are articulated around horizontal pivots 305, parallel to walls 12 and 13 and fixed to upper rear ends of longitudinal vertical sides of the chassis 30. In the arms 304 are slidably mounted two parallel arms 310 of drawer 31 extending rearwards. Arms 304 have vertical U-shaped cross-sections with facing flanges. Longitudinal sides of arms 304 forms webbings of the U-sections and have horizontal slits forming slides, extending above horizontal ribs 306 of chassis 30. Free rollers 311 with horizontal rotation axles are mounted at the rear of the arms 310 of the drawer and are designed to roll in the horizontal slits 3040 and on the ribs 306 when the arms 310 slide in arms 304 in the horizontal position. In addition, two helicoil spings 307 having front ends joined to stop washers 308 and rear ends hooked onto pivots 305 slide coaxially at the rear of pivoting arms 304.

The front of sliding arms 310 project from a coin box receptacle 312 in drawer 31. Receptacle 312 has also a parallelepipedic form similar to coin box 4 and comprises two horizontal struts 313 on which two lateral shoulders 40 of the coin box 4 rest. As shown in FIGS. 3 and 4, the coin box 4 has two lateral handles 41 for lifting the coin box up of the receptacle 313 when the drawer is drawn to the exterior.

The door and lock mechanism 5 is attached to a vertical front wall 314 of the drawer 31, forming a shielded door to compartment 3. A lock 50 of a known type is fixed through the shielded door 314 with, along the inside of its rear side, two pairs of vertically sliding and opposed lockbolts 51 cooperating with two clasps 52 attached to an internal side 121 of the front wall 12 of the post and located above and below the opening 120.

The mechanism 5 also comprises means for triggering an alarm before any attempt to break into the shielded door 314 and the lock 50. The alarm triggering means comprises a hollow counter-door 53 consisting of a stamped metal plate. The counter-door 53 is attached to the shielded door 314 by means of distortable metal fasteners 54 contained inside the counter-door, as shown in FIG. 4. The metal fasteners 54 are strips folded into a concertina shape and each having 540 fixed to a front inside vertical face 530 of the counter-door by means of a threaded rod welded to side 530 and taking a nut, and a rear end 514 riveted or welded to the shielded door 314, in order to prevent the fasteners being disassembled from the exterior.

In normal condition, the fasteners 54 flatten the counter-door 53 parallel against door 314, as shown in FIG. 4. A electric contact 55 housed in an upper side of the opening 120 cooperates with a horizontal tab 56 attached to the counter-door 53. When the drawer 31 is inside compartment 3 and an outside side 531 of the counter-door 53 is coplanar with an outside side 122 of the front wall 12 of the post with the bolts 51 being engaged in clasps 52, the contact 55 is kept closed on tab 56.

Figure 5:
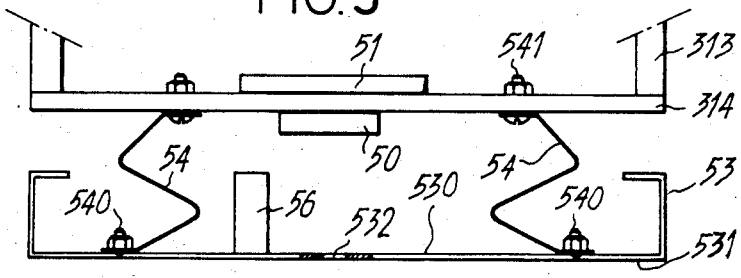

If an ill-intentioned person attempts to gain access to the lock 50 and the door 314, he must first pull forwards the counter-door 53 and thus stretch the fasteners 54, as shown in FIG. 5. The counter-door 53 is thus separated from the shielded door 314 and the tab 56 is moved away from the contact 55 which then switches to open and triggers alarm transmission. Opening of contact 55 controls an alarm device housed in the post 1, and/or triggers transmission of a special signal to a local telephone central office serving the telephone apparatus via the alarm telephone transmitting means and the telephone line. The alarm is broadcast in the form of a strident audible signal through the already mentioned loudspeaker, and/or the local central office alerts surveillance services, such as police. Thus, well before actual forcing of the coin box drawer 31, the alarm is given. The counter-door 53 can be economically returned to its normal position against door 314 simply by restoring the fasteners 54 to their original shape.

In addition, it is noted that the counter-door 53 protects the lock 50 against insertion bodies, and that fracture of the lock would require a long tool in order to pass through the key insertion hole 532 in the counter-door 53.

With reference to FIG. 3, the coin box compartment 3 is opened in two steps for removal of the coin box 14 and a third subsequent step for access to the inside of the post 1 and container 2.

At the beginning of the first step, a coin box collector inserts a key through hole 532. The key penetrates lock 50 and is turned to release from the clasps 52 the bolts 51 which come together vertically. The springs 307, at first compressed, expand to push stops 308 forwards a distance of a few centimeters $L_1$, the rear ends of arms 310 sliding in horizontal arms 304. After relaxation of springs 307, the front 53-314 of the drawer 31 projects from the front wall 12 of the post and enables the collector to grasp the drawer and pull it to the exterior.

It is to be noted that the presence of springs 307 allows a check to be made to ensure that the compartment 3 is correctly closed by verifying that the front 53-314 of the drawer is flush with the side 122. If the drawer is not locked with lock 50, the springs 307 will push the drawer out, and the tab 56 will be clear of the opening 120 and there will therefore be no closure of the door contact 55.

At a second step, the drawer 31 is pulled out a distance $L_2$ until the coin box 4 is in front of side 122 and can be removed from the receptacle 312 using the handles 41. A second electric contact 57 attached to the inside side 121 of the front wall 12 of the post is closed when pressed by the top 42 of the coin box 4 inside the receptacle 312 with the drawer closed. The contact 57 is thus opened at this second step, and signals coin box removal. Similarly, closure of compartment 3 by pushing and locking drawer 31 but without it containing a coin box, also keeps contact 57 open. Contact 57 open thus signals that the coin box is missing from compartment 3, and contact 57 open with contact 55 closed signals that the coin box is missing after the compartment has been closed. Contacts 55 and 57 are connected in series, and consequently, opening of contact 57 also triggers broadcasting of the audible alarm and/or transmission of an alarm signal to the local central office. In particular, removal of a full coin box by the collector not followed by insertion of an empty coin box into receptacle 312 and closure of the compartment by pushing and locking the drawer is signalled. In other embodiments, electric contacts 55 and 57 may be replaced by photoelectric cells or magnetic contacts.

It will be noted that the telephone apparatus comprises a first "passive" electronic equipment housed inside post 1 which allows the power supply to be cut off from the electromechanical card reading and coin sorting and testing means as soon as the compartment is opened, in order to make it impossible to establish a telephone communication. In addition, the local central office is linked to a second "active" electronic equipment which controls broadcasting of the alarm through the loudspeaker and transmission of the alarm to surveillance services only outside perdetermined coin box removal periods. These two electronic equipments will not be described and do not enter in the scope of the invention.

During the second step corresponding to pulling out of drawer 31, the rams 310 slide forwards in pivoting arms 304 which are held horizontal by the rollers 311 rolling and resting on horizontal ribs 306 of chassis 30. After removal of coin box 4, when rollers 311 are forwards of the front edges 3060 of the ribs 306 and only rest on the slits 3040, the drawer 31 may then be lowered by an angle $\alpha_3$ of about 20°, by pivoting arms 304 about horizontal pivots 305. This third step allows the container 2 to be released from the post 1 and access to be gained to the inside of the post 1, by means of the locking device 6 described below and located in post 1, between the base 10 and the chassis 30 of the compartment.

Figure 6:
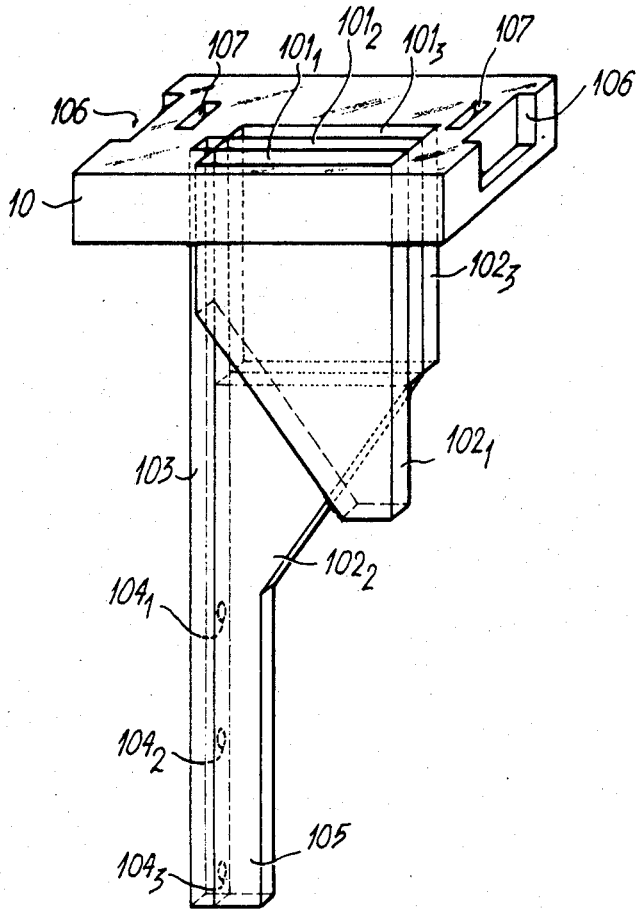
FIG. 6 is a schematic perspective view of a base fixed to an upper part of the post, capped by the container and supporting in particular coin chutes located within the post.

As schematically shown in FIG. 6, the base 10 has the shape of a parallelepipedic block mounted on the upper edges of the walls of post 1 and closing it off. Subtantially at the center of base 10 and parallel to walls 12 and 13 of the post are provided three adjacent narrow rectangular slots $101_1$, $101_2$ and $101_3$ into which are inserted a coin refund chute $102_1$, a coin collection chute $102_2$ and a printed circuit board rack $102_3$ respectively. The tops of chutes $102_1$ and $102_2$ and rack $102_3$ are attached to the base 10 or rest on the base, and the rest projects vertically beneath base 10 and above chassis 30. The chutes and the rack are made of sheet metal or plastic. Regions of the chutes subjected to impacts and frictions from the coins are preferably reinforced with metal plates.

Chutes $102_1$ and $102_2$ are located beneath electromechanical switching means located at the level of the coin storage zones and included in the coin sorting and testing means attached to chassis 28 in container 2. A lower end of chute $102_1$ converges towards the bottom in the direction of the refund dish 11. A lower end of chute $102_2$ converges towards the bottom above a coin reception slot in coin box 4, when the latter is inside the compartment 3 with the drawer 31 locked. As can be seen in FIG. 6, the collection chute $102_2$ abuts vertically against a duct 103 containing electrical cables. The cables notably connect contacts 55 and 57, the telephone line, the microphone and earpiece of handset 7 and photoelectric or magnetic coin passage detectors $104_1$, $104_2$ and $104_3$ to the electronic circuits on the printed circuit boards housed in rack $102_3$. Rack $102_3$ in particular contains the electronic circuits concerning the audio circuit of the telephone apparatus, the card reading means, the coin sorting and testing means, the dialling keyboard 24 and the passive equipment already mentioned.

The three detectors $104_1$, $104_2$ and $104_3$ are located at three different levels along the lower vertical end 105 of chute $102_2$ placed above the coin box and only allowing collection of one coin at a time. The detectors take part in the validation of coin collection so that this can be signalled to the active equipment associated with the local central office via the telephone line. Passage of a coin along a route other than normal descent through the switching device and coin box, for example following fraudulent extraction of a coin from the coin box, is also detected.

Base 10 also comprises two lateral recesses 106, designed to receive complementary portions, such as feet, of container 2 so that it can be easily grasped when released from the post, as will be seen hereinafter. Between the recesses 106 and the ends of the slots $101_1$, $10_2$ and $101_3$ there are two small lateral crossing mortises designed to receive the greater part of locking device 6.

As shown in FIG. 3, the locking device 6 comprises two vertical linkrods 60 having lower ends 61 hinged on pivoting arms 304, and upper ends 62, in the shape of an angle bracket, sliding in the mortises 107 of base 10. In each mortise 107, the locking device 6 comprises two levers 63 each having two arms 630 and 631 on either side of an elbow 632 with an angle of about 120°, are rotatably mounted around a horizontal axle in the mortise 107. A free end of the first arm 630 of each lever 63 connects with the upper end 62 of the linkrod 60 and has a roller 633 sliding in an oblong horizontal slit in the bracket-shaped end 62, extending parallel to walls 12 and 13. A free end of the second arm 631 of each lever 63 slots into a small horizontal groove 290 beneath a lower part of the container 2, forming a tenon 29, sliding in the respective mortise 107 of base 10 and complementary to the mortise.

As shown by heavy lines in FIG. 3, when the pivoting arms 304 of chassis 30 of the coin box compartment 3 are horizontal, the upper end 62 of the linkrod 60 is in a raised position and is substantially flush with the upper horizontal surface of the base 10. The first arms 630 of the two levers 63 in each slit 620 form an angle of about 60° with an apex pointing upwards, and the second arms 631 are horizontal and hold the tenons 29 in the mortises 107 so that the lower part of the container 2 surrounds the base 10 and so that container 2 is locked onto post 1.

At the beginning of the third step defined above, the drawer 31 is pulled forwards so that the rollers 311 are no longer supported by the ribs 306 of chassis 30 and abut against the forward ends of the slots 3040 of arms 304. The drawer 31 is then pivoted downwards around the pivots 305, for example the collector may use his foot, until the lower surface of the coin box receptacle 312 stops against the front lower end of chassis 3 in opening 120, as shown by mixed lines in FIG. 3. The drawer 31 has thus pivoted by angle $\alpha_3$. The pivoting of the arms 304 pulls the linkrod 60 vertically downwards, as shown by the mixed lines in FIG. 3. During pivoting of the drawer, the levers 63 in each mortise 107 turn in opposite directions by an angle of about 60° following the pulling downwards of the rollers 633 by the upper end 62 of the linkrod 60. Simultaneously, the second arms 631 turn upwards and approach the vertical in order to raise container 2 by pushing against the tenons 29 and disengaging the free ends of arms 631 from the grooves 290, which releases the container 2 from the post 1. At the end of the third step, the lower part of the container 2 is substantially touching the base 10. Container 2 may then be removed from chassis 28 so that access is gained to the devices on chassis 28 and the collector can pass his hand through opening 120 in the post to access a pull-ring in device 8 for releasing the microphone and earpiece capsules in handset 7.

Figure 7:
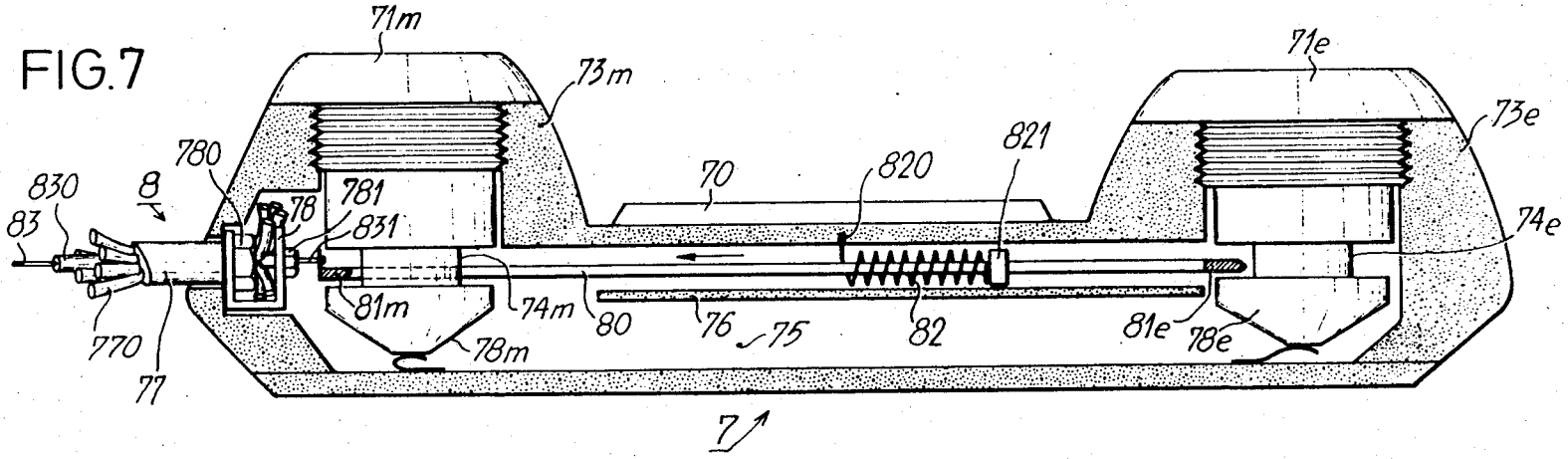
FIG. 7 is a longitudinal cross-sectional side view of a telephone handset including a sliding frame to join removable microphone and earpiece capsules of the handset.
Figure 8:
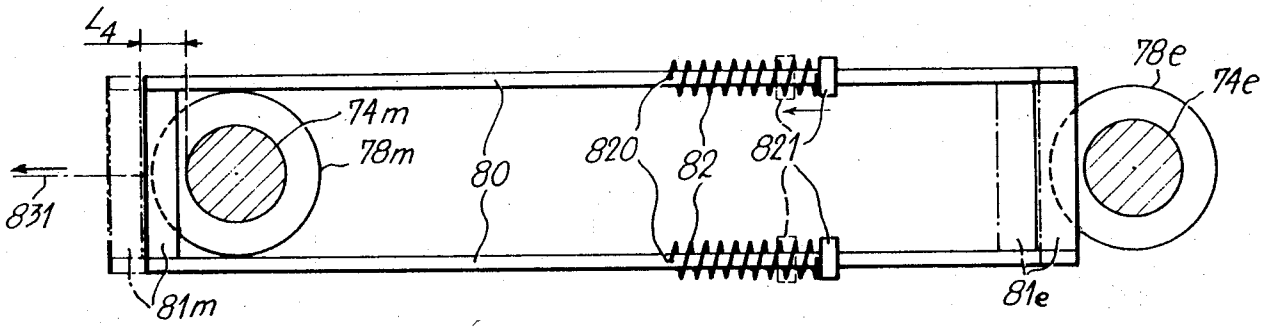
FIG. 8 is a top view of the sliding frame in positions allowing removal and joining of the capsules.

As shown in FIGS. 7 and 8, ends of the handset 7 comprise two tapped bosses **73*m* and 73*e* into which the microphone capsule 71*m* and the earpiece capsule 71*e* are screwed respectively. Beneath threaded sections of cylindrical portions of capsules 71*e* and 71*m* are provided annular grooves 74*e* and 74*m* which are located beneath the bosses 73*m* and 73*e* and inside an internal cavity 75 of the handset 7**, when the capsules are fully screwed into the bosses.

The grooves **74*e* and 74*m* on the capsules work together with a flat rectangular blocking frame 80 of the device 8 which is slidably mounted between guides 76 preformed in the cavity 75 and perpendicular to the axes of the capsules and bosses. In a position blocking capsules 71*m* and 71*e*, small flat sides 81*m* and 81*e* of frames 80, forming bolts, are engaged in the grooves 74*m* and 74*e* respectively, by means of two helicoil springs 82 vertically surrounding thin longitudinal sides of frame 8, sliding in guides 76. One, 820, of the ends of each spring 82 is anchored to the cavity 75 of the handset on the 73*m* boss side, and the other end, 821**, of each spring 82 is attached to the frame 8 on the 73*e* boss side, which pushes frame 8 from boss 73*m* towards boss 73*e*.

In the end of handset 7, on the 73*m* microphone boss side, a strong flexible metal cord 77 penetrates, and protects six conductor wires 770 which connect the microphone, the earpiece and a relay contact controlled by trigger 70 to the telephone apparatus audio circuit. An end of the cord 77 is attached to the handset by a stop ring 780 joined to a branch of a U-shaped yoke fixed in cavity 75, under boss 73*m*. Another branch of the yoke 78 is fitted with a stop ring 781 pinching a sheath 830 of a traction cable 83, this cable having an end 831 attached to bolt 81*m*. Cable 83 is positioned at the centre of cord 77 and is surrounded by conductor wires 770. The traction cable 83 helps to strenghten the telephone cord 77, the better to withstand attempts to rip out the handset 7.

Figure 9:
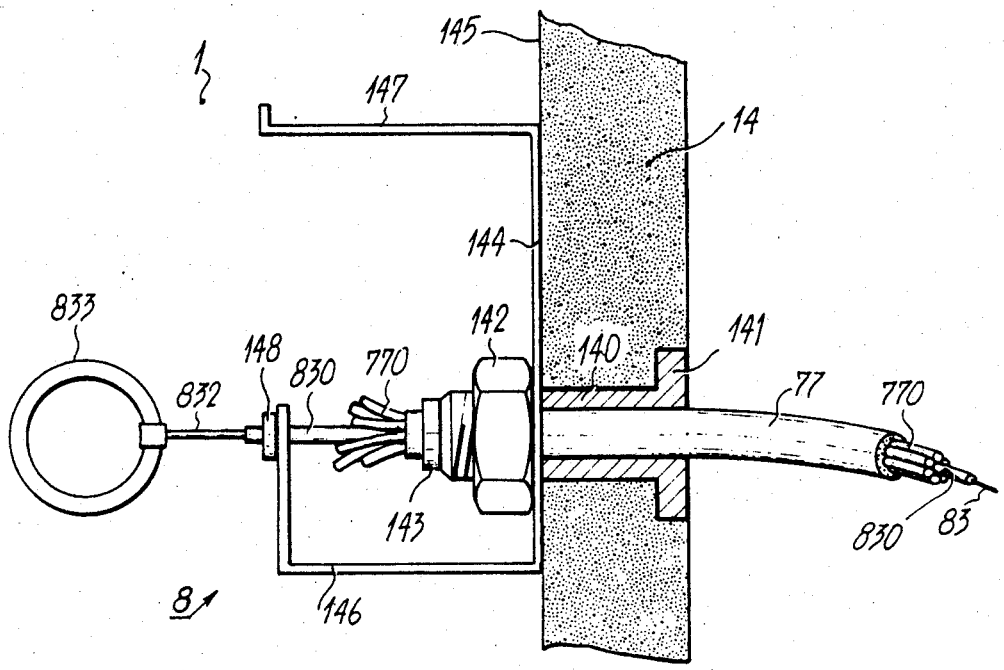
FIG. 9 is a vertical cross-sectional schematic view showing means accessible from the interior of the post for pulling the sliding frame via a traction cable guided in a flexible cord connecting the handset to the post.

As shown in FIG. 9, a second end of the protection cord 77 passes through a bushing 140 attached to a vertical side wall 14 of post 1, by means of an external collar 141 and an internal nut 142 passing through wall 14. The second end of the cord 77 is attached to the inside of post 1 by means of a stop ring 143 joined to bushing 140. The nut 142 also enables a U-yoke 144 to be flattened against the internal side 145 of wall 14. Yoke 144 has two horizontal branches 146 and 147 having upwards vertically folded ends. The vertical end of branch 146 supports a stop ring 148 for a second end of sheath 830 of the traction cable 83 which leads from stop ring 143 jointly with the conductor wires 770 penetrating the vertical duct 143 just beneath the base 10. The second end 832 of the traction cable 83 leading from ring 148 is fixed to a pull-ring 833.

When a repairer wishes to replace one or other of the handset capsules 71*m* and 71*e*, the coin box compartment 3 is opened, as previously described, by pulling out the drawer, so that the repairer can insert his hand between the wall 12 of post 1 and the shielded door 14, beneath the drawer 31 and through the opening 120 (FIG. 3), and thus grasp pull-ring 833. The ring 833 is pulled to exert traction on cable 83 which slides in the sheath 830, over a length $L_4$ greater than the depth of the annular grooves 74*m* and 74*e*, as shown in FIGS. 7 and 8. Frame 80 slides on the guides 76 from boss 73*e* towards boss 74*m* so as to free bolts 81*m* and 81*e* from grooves 74*m* and 74*e* respectively, as shown in mixed lines in FIG. 8. The traction exerted on cable 83 against the return force of the springs 82 is maintained by hooking the ring 833 over the second branch 147 of yoke 144, which forms a hook. In this case, capsules 71*m* and 71*e* may be unscrewed from bosses 73*m* and 73*e* to the handset by unhooking ring 833 from hook 147, bolts 81*m* and 81*e* will engage in grooves 74*m* and 74*e* on the new capsules by the relaxation of the springs.

However, it should be noted that unhooking ring 833 from the hook after removal of capsules 71*m* and 71*e* does not prevent new capsules from being screwed in. Indeed, capsules 71*m* and 71*e* have conical pointed lower ends 78*m* and 78*e* immediately below grooves 74*m* and 74*e*. When the capsules are screwed in, pointed ends 78*e* and 78*m* gradually push aside bolts 81*m* and 81*e*, in a similar manner to the traction on cable 83, until grooves 74*m* and 74*e* are at the same level as the frame 80. In any case, because of the force exerted by springs 82 engaging bolts 81*m* and 81*e* in grooves 74*m* and 74*e*, it is impossible to remove capsules 71*m* and 71*e* from the handset 7.

Figure 10:
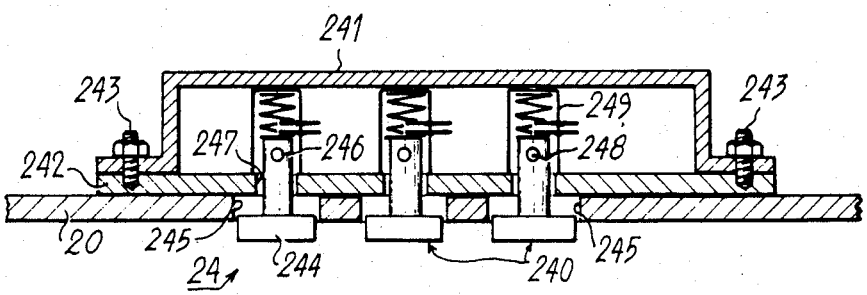
FIG. 10 is a cross-sectional schematic view of a keyboard fixed to the inside of the apparatus container.

As already stated, only the dialling keyboard mechanism 24 is attached to front panel 20, inside the container. The refund and end-of-communication pushbutton 25 and the contacts it controls are laid out in the same way as the key and contacts of the keyboard mechanism 24. With reference to FIG. 10, the keyboard mechanism is enclosed in a protective case 241 fixed against the wall 20 by means of a perforated backing plate 242, forming a grille, by means of bolts 243 which can not be seen from the outside. Grille 242 forms an integral part of container 2 and may be welded to the inside of it. Each key 240 has a T-shaped horizontal cross-section whose branches make a prismatic block which recesses into a hole 245 made in the wall 20 of the container, and whose leg 246 slides through a hole 247 in the backing plate 242. Extraction of the keys 240 from the outside is prevented by means of pins 248 which pass through the legs 246 of the keys and slide along slots made in recesses 249 in the case 241. The recesses 249 each contain a conventional key return spring and respective contacts. The refund bottom 25 is similar to keys 240 and is also protected against being torn off by a pin mounting assembly.

Although the invention has been described as based on a public telephone apparatus, the majority of the essential devices and mechanisms belonging to the object of the invention, such as the translatable and pivoting drawer 31, the door and lock mechanism 5 of the coin box compartment 3 and the device 6 for locking container 2 on post 1, may be adapted to any prepayment product or service dispenser. When the dispensing apparatus comprises a keyboard, this may be as described with reference to FIG. 10.

What I claim is:

1. A prepayment product or service dispensing apparatus comprising a post anchored to the ground and including a closable compartment containing a removable coin box, and a container attachable to the post, characterized in that the post comprises means for concomitantly opening the compartment, extracting the coin box from the compartment and releasing the container from the post for access to internal means included in the post and the container.

2. Apparatus according to claim 1, characterized in that it comprises means for simultaneously translating said coin box and a door closing the compartment to the outside of the post.

3. Apparatus according to claim 2, characterized in that the translating means comprises a drawer supporting said coin box and said door and sliding in slides within the compartment, said drawer abutting against first ends of the slides when the coin box is in the compartment and said door closes the compartment, and said drawer abutting against second ends of the slides when the coin box and the door are outside the compartment.

4. Apparatus according to claims 2, characterized in that it comprises means for locking the door onto the post and means for pushing the translating means out of the compartment as soon as the door is unlocked from the post.

5. Apparatus according to claim 1, characterized in that the compartment comprises contact means working mechanically in conjunction with a surface of the coin box for signalling absence of the coin box from the compartment.

6. Apparatus according to claim 5, characterized in that it comprises means, preferably housed in the container, for broadcasting an audible alarm signal when the coin box is absent from the compartment, and/or means, preferably housed in the post, for transmitting an alarm signal via a telephone line when the coin box is absent from the compartment.

7. Claim according to claim 1, characterized in that the compartment comprises contact means working mechanically in conjunction with a portion of a door closing the compartment for signalling opening of the compartment by the door.

8. Apparatus according to claim 7, characterized in that it comprises means, preferably housed in the container, for broadcasting an audible alarm signal when the compartment door is opened and/or means, preferably housed in the post, for transmitting an alarm signal via a telephone line when the compartment door is opened.

9. Apparatus according to claim 1, characterized in that it comprises a counter-door fixed against a door closing the compartment, and in that the compartment comprises contact means working in conjunction with an internal portion of the counter-door to signal the cover door moving away from the door.

10. Apparatus according to claim 9, characterized in that a external side of the counter-door is flush with a external side of the post when the door and the counter-door close the compartment.

11. Apparatus according to claim 9, characterized in that counter-door is fixed to the door by distortable means, such as bendable metal fasteners.

12. Apparatus according to claim 9, characterized in that it comprises means, preferably housed in the container, for broadcasting an audible alarm signal when the counter-door moves away from the door, and/or means, preferably housed in the post, for transmitting an alarm signal via a telephone line when the counter-door moves away from the door.

13. Apparatus according to claim 1, characterized in that it comprises means controllable from the open compartment for releasing the container from the post.

14. Apparatus according to claim 13, characterized in that the releasing means comprises a linkrod housed in the post and having an end located in the compartment and a second end under the container, and means partly engaging in the container and connected to the second end of the linkrod for raising the container above the post when the first end of the linkrod is lowered in the compartment.

15. Apparatus according to claim 14, characterized in that the raising means comprises at least a lever rotatably mounted around an axle fixed to the post and having a first end sliding in a slot in the second end of the linkrod and having a second end engageable in the container to lock the container onto the post and disengageable from the container to raise the container above the post.

16. Apparatus according to claim 15, characterized in that the container comprises a tenon subjacent to the container, and the post comprises a subjacent base fittable into the container and having a mortise to receive said tenon, said tenon comprising a groove engaging with the second end of said lever.

17. Apparatus according to claim 2, characterized in that the translating means pivotable when said coin box and said door are outside the post, and is connected to the releasing means, pivoting of the translating means triggering release of the container from the post by means of the releasing means.

18. Apparatus according to claim 3, characterized in that said slides are connected to the releasing means and are pivotable in the compartment when the drawer is substantially in abutment against said second ends of the slides.

19. Apparatus according to claim 18, characterized in that the drawer comprises arms sliding in said slides, fitted with rollers which roll and rest on tracks fixed to the compartment when the drawer is translated and which are cleared of said tracks when the drawer and said slides are pivoted.

20. Apparatus according to claim 14, characterized in that said first end of said linkrod is hinged to one of said slides.

21. Apparatus according to claim 1, characterized in that it comprises a base which fits under the container and through which passes a coin refund chute, a chute to collect coins into the coin box, and an electronic circuit rack, said chutes and said rack being accessible from the compartment.

22. Apparatus according to claim 1, characterized in that the post contains a coin collection chute along which are located means for detecting abnormal routing of each coin to be collected between said coin box and said container.

23. Apparatus according to claim 1, characterized in that it comprises a keyboard having keys partly recessing from the outside into a wall of the container and partly removable mounted inside a case attached to an internal side of said container wall.

24. Apparatus according to claim 1, comprising a telephone handset equipped with a removable microphone capsule and a removable earpiece capsule, and a flexible cord connecting the handset to the post, characterized in that it comprises means controllable from the inside of said compartment for separating said microphone and earpiece capsules from the handset.

25. Apparatus according to claim 24, characterized in that the separating means comprises means sliding which said handset and disengageable from said capsules, and a traction cable, preferably sheathed, passing through said cord and having a first end accessible inside the compartment.

26. Apparatus according to claim 25, characterized in that the compartment comprises means for hooking a second end of the cable and keeping it stationary when the sliding and disengageable means is disengaged from the capsules.

27. Apparatus according to claim 25, characterized in that the sliding and disengageable means comprises a frame sliding inside the handset, and a spring means for engaging portions of the frame in grooves in the capsules, said traction cable being pulled to free said portions of the frame from the capsules.

28. Apparatus according to claim 24, characterized in that the capsules have ends pointed and located immediately below the portions of the capsules which engage with the separating means.

* * * * *